US005706258A

United States Patent [19]

Poe et al.

[11] Patent Number: 5,706,258

[45] Date of Patent: Jan. 6, 1998

[54] TIMED REPEATING INSTRUCTIONS APPARATUS AND METHOD

[76] Inventors: Linda Roark Poe, 7401 Eastmoreland Rd. Apt. 625 P.O. Box 517, Annandale, Va. 22003; Jimmie L. Sanders, 4842 Winsloe Rd., Roanoke, Va. 24012

[21] Appl. No.: 582,941

[22] Filed: Jan. 4, 1996

Related U.S. Application Data

[63] Continuation-in-part of Ser. No. 243,713, May 16, 1994, abandoned.

[51] Int. Cl.[6] ..... G04B 21/08

[52] U.S. Cl. ..... 368/274; 368/10; 368/63

[58] Field of Search ..... 368/10, 63, 73, 368/12, 41, 72–74, 250, 251

[56] References Cited

U.S. PATENT DOCUMENTS

| | | | |
|---|---|---|---|
| 3,632,880 | 1/1972 | Goldschein et al. | 368/63 |
| 4,074,251 | 2/1978 | Greely | 346/309.4 |
| 4,302,752 | 11/1981 | Weitzler | 340/309 |
| 4,490,711 | 12/1984 | Johnson | 368/10 |
| 4,498,787 | 2/1985 | Jung-Sun | 368/10 |
| 4,768,176 | 8/1988 | Kehr et al. | 368/10 |
| 5,088,056 | 2/1992 | McIntosh et al. | 368/10 |
| 5,199,009 | 3/1993 | Svast | 368/240 |
| 5,369,797 | 11/1994 | Tyree | 455/349 |

*Primary Examiner*—Bernard Roskoski
*Attorney, Agent, or Firm*—Lalos & Keegan

[57] ABSTRACT

An apparatus and method for instructing an impaired individual to perform an act using:

a voice recorder capable of recording a series of different voice recordings of a person whose voice is recognized by the individual to provide a series of different recorded instructions to the impaired individual, a playback capable of playing seriatim one of the series of said recorded instructions in the series, a repeating means connected to the playback and capable of repeating the playing of said recorded instructions until stopped, a timer connected with the playback, the timer capable of activating said playback at multiple, preselected time intervals to provide for a series of multiple timed recorded instructions played seriatim during the day to the impaired individual, and a switch for the repeating means operated by the impaired individual to stop the repeating means after anyone of a selected playback of a recorded instruction.

1 Claim, 3 Drawing Sheets

FIG. 2
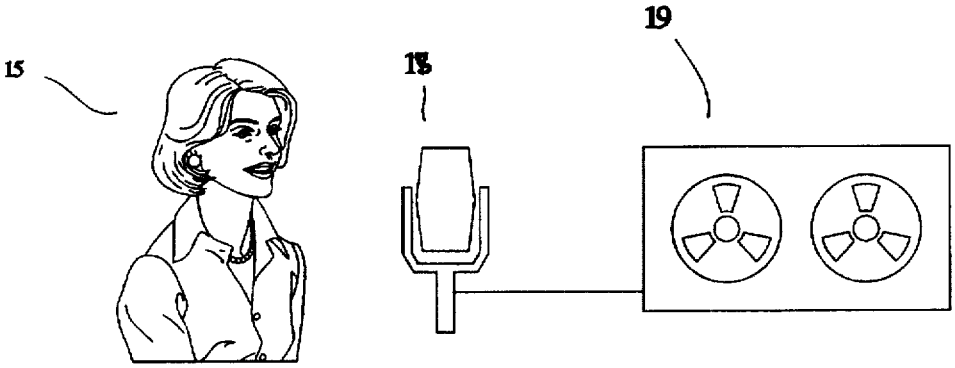
FIG. 3
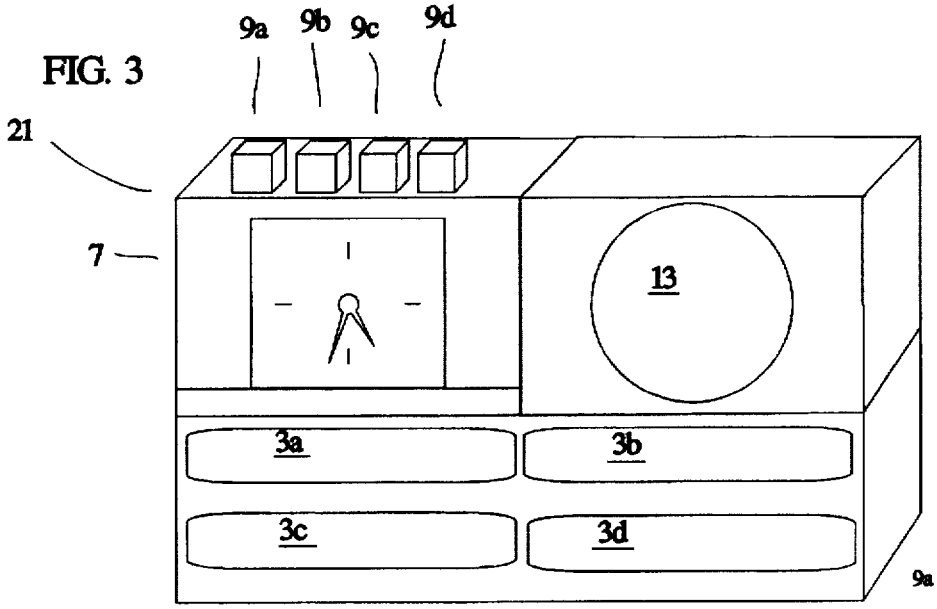
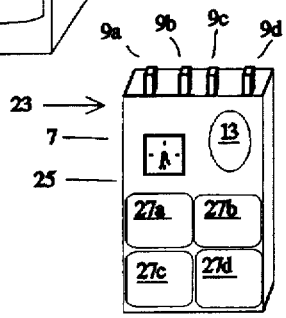
FIG. 5

TIMED REPEATING INSTRUCTIONS APPARATUS AND METHOD

This application is a continuation-in-part of U.S. application Ser. No. 08/243,713 filed May 16, 1994, now abandoned.

FIELD OF THE INVENTION

This invention relates generally to an apparatus that emits repeating voice instructions to a mentally impaired individual to perform a simple but essential task, such as taking medication.

BACKGROUND OF THE INVENTION

Individuals who are ill often forget to take medication, or overdose because they forgot they took it in the first place. Often when an individual becomes seriously ill, the individual suffers employment loss, loss of health insurance or insurance rates become extremely high, and loss of friends. Over 700,000 individuals are now seeking disability payments from Social Security that entails proceeding through a bureaucratic ordeal causing worry to the individual. The seriously ill individual can also worry constantly about dying, and where the money is going to come from to continue living. Such constant worry adversely affects memory. In addition, the seriously ill individual feels abandoned. In addition some illnesses cause brain damage adversely affect an individual's memory.

A number of inventions are directed to reminding an individual to do an act such as taking medication. For example U.S. Pat. No. 5,199,009 of Svast (1993) discloses a reminder clock which includes an audio recorder for providing a reminder message in the user's own voice. While the reminder clock is an effective reminding device, there is no assurance that the reminder message registered with the ill individual or that the ill individual acted upon the reminder. Many ill individuals require an almost toxic level of medication to maintain life. Too much or too little can be fatal. It is essential that they be aware of the reminder.

U.S. Pat. No. 4,498,787 Lin Jung-Sun (1985) is directed to a reminding device for a busy individual. The device has a buzzing speaker which indicates that a reminder message is in a tape recorder. The busy individual can then turn on the tape recorder to hear the message. Again there is no assurance that the busy individual heard the buzzing speaker or acted upon it.

U.S. Pat. No. 4,490,711 Johnston (1984) discloses a pocket alarm system for indicating when medicine is to be taken. The system records the number of times the alarm has been turned off to check to see if the individual has taken the required amount of medicine. The system provides multiple reminders for multiple kinds of medication, but without a repeating voice recording, a mentally impaired or deficient patient may not be capable of properly responding.

U.S. Pat. No. 4,074,251 Creely (1978) discloses an appointment reminder which can be constructed pocket size. Again, there is no voice reminder.

U.S. Pat. No. 4,768,176 Kehr (1988) discloses a pill dispensing apparatus which alerts a patient to take medication. Multiple times for taking different medications can be set. If the medication is not taken an alarm is sounded. An audible signal generator is used to alert a patient to take medication. A voice Synthesizer or recorder could also be used to alert a patient to take medication. There is no suggestion that the recorded message be repeated.

U.S. Pat. No. 4,302,752 Weitzler (1981) discloses a time-keeping device for issuing reminders at predetermined times and includes a computer with a memory for receiving and storing information and a processor for processing the stored information. A clock provides timing signals to the processor and an audio system records and reproduces messages on distinguishable tracks of a recorder. Information identifying a plurality of specific future times each associated with one of the tracks is introduced into the computer memory by a programmer and a selector selects any of the tracks for operative coupling to the audio system. In response to the occurrence of a specific time preset into its memory, the computer energizes a signalling device to alert an individual that activation of the audio system will produce a message reminder previously recorded on at rack associated with the occurred time and automatically selected by signals from the processor. There is no automatic playing of a voice recording by a person known to the individual listener, nor is there any repeat of the voice recording to assure that the individual listener has responded to the recording or any off switch for the individual to indicate that he has heard and responded to the recording. Without these important features, this patented system would be useless to a mentally impaired individual.

Along the same lines is a computer program, WIRED FOR SOUND by Ernest Priestly, President of Aristosoft, Inc., 7041 Koll Center Parkway, Suite 160, Pleasanton, Calif. 94566. The program allows one to record one's voice into a computer to be used in conjunction with an appointment calendar.

As used herein the term "impaired" shall mean an individual who is mentally disadvantaged in that he/she is deficient in mental power and short term memory capability and thus exhibits an inability to remember to perform according to a simple prescribed schedule such as for meeting medication, dietary and hygienic requirements during particular times of each day. An impaired individual may for instance have been brain damaged, suffer from a short term memory, memory loss dementia syndrome or in general are geriatric patients.

SUMMARY OF THE INVENTION

The present invention is based upon the discovery that an individual who is impaired can be repeatedly instructed to perform an act. If the individual is instructed again and again by a recorded voice of a person familiar to the individual, a family member or a friend, there is a significantly greater opportunity for the act to be performed. The voice instruction can be recorded on a recording tape, a magnetic or optical disk, on a computer chip or any other known recording media. A timer or timers control the playing of the voice instruction on a playback recording, which is timed to play a short time or immediately before the act is to be done. If the individual does not turn off the recording after the first playing, the voice instruction is repeated over and over again by repeating means connected to the playback until it is turned off by the individual. The playback of the instruction is preferably in a housing that can be placed on a night stand next to the individual's bed if the individual is bedridden, or in any location suitable to the needs of the individual, whether ambulatory, semi-bedridden or bedridden. It is preferred that labeled groups or packets of medication be placed on the night stand or other suitable location for the individual to take at the preset times.

To be more specific the apparatus for an individual of the present invention comprises a voice recorder capable of recording instructions or a message in a voice of a person whose voice is recognized by the individual. Playback apparatus is capable of playing the voice instruction. This playback can be one or more apparatus such as a digital playback apparatus to playback the instructions recorded on a single tape, for a single playback apparatus or multiple tapes for multiple playbacks, a magnetic or optical disk, or on a computer chip. Repeating means is connected to the playback to repeat playing the recorded voice instructions until the playback is switched off by the individual. The recording can be switched off electrically or mechanically or both as is known in the art. A timer associated with the playback controls when the recording or recordings will be played and the number of different times of the day that each recording will be played. The timer is capable of multiple, preselected time settings during a day to provide for multiple timed repeated instructions during the day to the individual. The timer is an electronic timer. Timers, as well as timer controlled recording players, and timer controlled audio signalling devices are well known in the art. A switch whether mechanical or electrical turn off device is provided for each playback apparatus. The switch is operated by the individual to turn off the playback function after each instance that the listener is instructed and the act performed. Switches that turn off devices for recording players are also known in the art.

The recorded instructions to the individual are to do an act or acts such as taking medication, rolling over to prevent bed sores, applying medication, eating and other essential functions that some impaired individuals are not only incapable of remembering but also are incapable of recognizing the meaning of sounds other than the voice of a known individual.

The apparatus referred to above is capable of making multiple different voice recordings and playing back different voice recordings on playback apparatus at different times of the day instructing an individual of an act or acts to be done.

This invention is to be used, primarily, for impaired individuals who cannot remember to take their medications and perform other daily routine acts. It is designed, also, for impaired individuals who are deficient in mental power, however, patients who have been rehabilitated to their maximum mental potential, yet require mental cueing to remember to perform acts of daily routine living. The apparatus and method of this invention will allow the rehabilitated impaired individual to return to their own home of familiar surroundings, thus, living their lives with minimal dependence upon and supervision from others.

BRIEF DESCRIPTION OF THE DRAWINGS

FIG. 2 is a drawing recording the instructions.

FIG. 3 is a drawing of a timed player, instruction device, which repeatedly plays the record instructions.

DETAILED DESCRIPTION OF THE INVENTION

Figure 1:
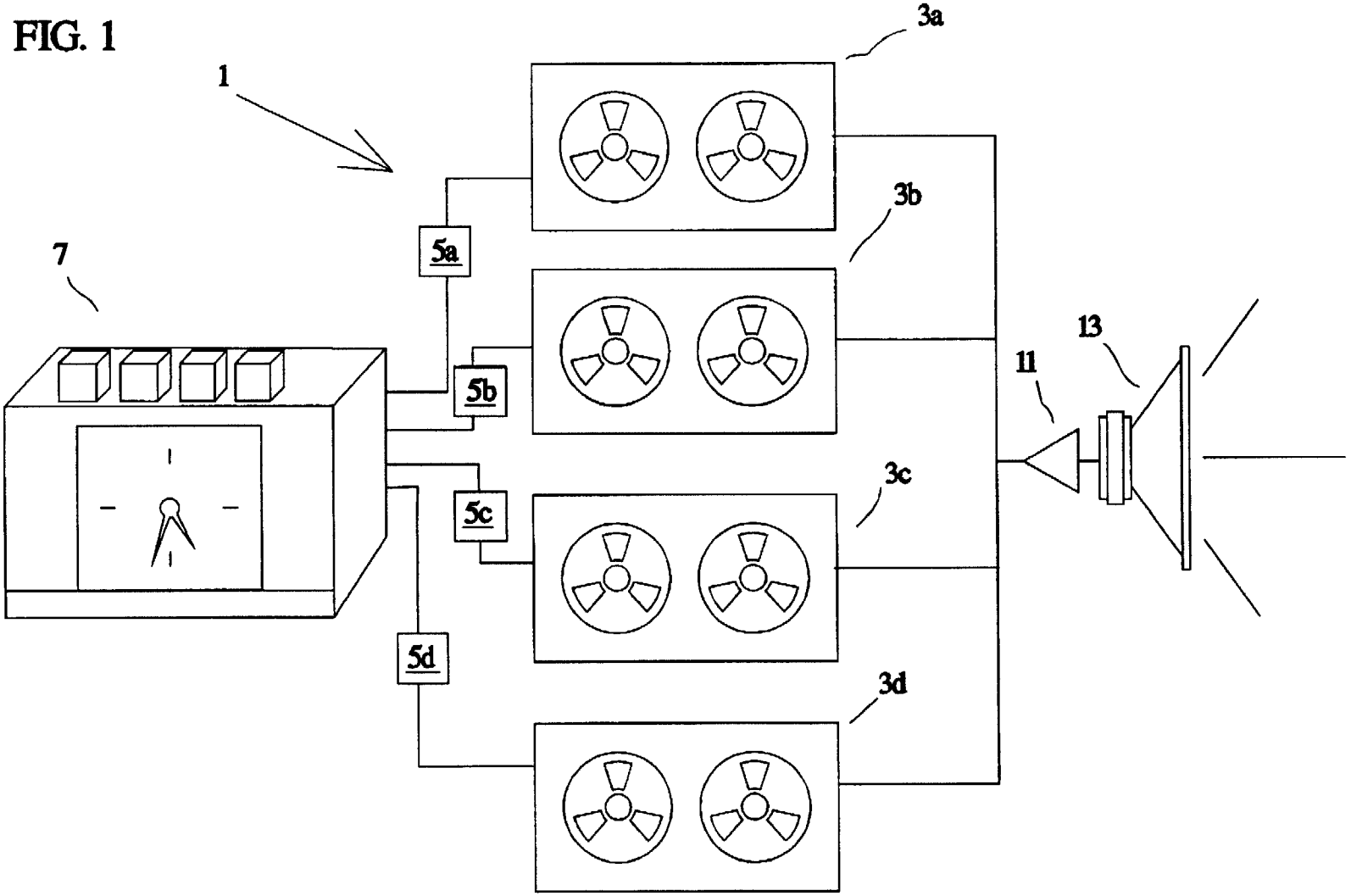
FIG. 1 is a combination pictorial diagram of the apparatus and a circuit diagram of the circuits connecting the apparatus used in the practice of the present invention.

Referring now to FIG. 1, apparatus 1 consists of a multiple, such as four, tape players or playbacks 3*a*, 3*b*, 3*c* and 3*d*, each having an automatic rewind or repeating means providing for automatic replay of each tape until the tape player is turned off. Each tape player or playback is a Radio Shack SCP-32 and has an integrally connected repeating means, 3A1, 3B1, 3C1 and 3D1 respectively. The tape in each tape player can be a short tape such as that used as a recorded voice message tape in a telephone answering machine. The tape records on a separate recording machine 19 (see FIG. 2). Each tape player receives its power from a corresponding timer module 5*a*, 5*b*, 5*c* and 5*d* plugged into a power strip (an extension cord with multiple outlets) and play the different tapes seriatim. A separate timer module is used for each tape player. The timer module used is a Radio Shack 61-2681A timer module to enable each tape player play at preselected time intervals. The timer modules 5*a*, 5*b*, 5*c* and 5*d* are controlled by a remote control timer 7 plugged into the same power strip. The remote control timer 7 is a Radio Shack 61-2670 remote control timer.

At the time or shortly before the time the first act is to be done by the impaired individual, timer 7 sends a signal to timer module 5*a*. Timer module 5*a* then turns on tape player or playback 3*a*. Playback 3*a* then plays and the repeating means has the playback repeat the recorded voice instruction or message "A" instructing the impaired individual to do the act identified in the recorded instruction "A" until the individual turns off playback 3*a* by depressing timer switch 9*a*. The audio output of playback 3*a* is fed into audio amplifier 11, which amplifies the signal to drive speaker 13. Timer 7 can be programmed to instruct the individual to do act "A" any number of times during the day or act "B" or "C" etc. seriatim at preselected times as set on the timer. The term "act" can mean a singular act, more than one act or a series of acts. The term "act 'A'" does not necessarily mean the first act to be done, but may mean one of a number of acts that the individual is to be instructed to do.

Figure 4:
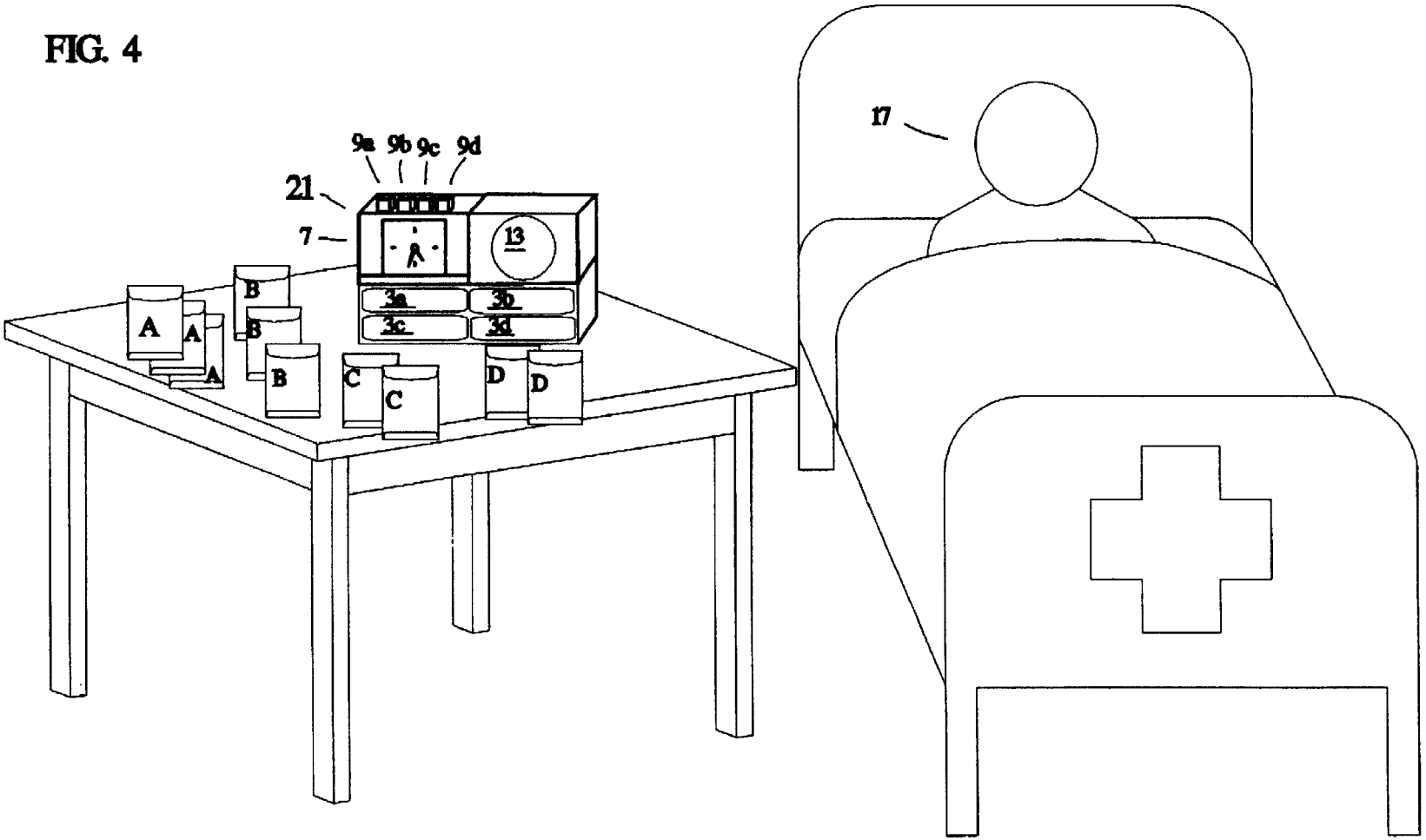
FIG. 4 is a drawing of, the instruction device, an impaired individual to be given instructions to take medication at timed intervals, and packets of medication.

In operation, medication to be taken, for instance, at a particular time "A" is placed in a labeled packet (see FIG. 4). The recorded voice instruction "A" instructs the patient to take the medicine in the labeled packet as act "A". A number of packets of medication may be prepared to be taken in response to message "A" during the course of a day. After the impaired patient hears and understands message "A", he depresses switch 9*a* to turn off playback 3*a*. Until the patient depresses switch 9*a*, the recorded instruction will continually repeat by reason of repeating means as a constant instruction. A different combination of medication may go into packet "B" to be taken in response to a different recorded instruction/message on playback 3*b*.

Turning now to FIG. 2, there is shown a prospective caretaker 15, who may be a well known friend, including spouse and relative of the patient and therefore having a recognized voice, making a series of tape recordings instructing the impaired individual 17, as to what to do during particular times of the day (see also FIG. 4). Caretaker 15 recites four sets, for instance, of instructions into microphone 18, and the voice instructions are recorded on a series of four (for example) tapes that are introduced sequentially into tape recorder 19 to form the recorded voice instructions. The apparatus of FIG. 1 may be consolidated into a single cabinet 21, for example. (See FIG. 3). The cabinet may be placed on a table at the bedside of individual 17 (see FIG. 4).

The four tapes recorded by the caretaker are individually placed in playbacks 3*a*, 3*b*, 3*c* and 3*d*. At the time the medication in packet "A" is to be taken, timer 7, turned on tape player 3*a* to instruct individual 17 to take the medication in packet "A". The repeating means in playback 3*a* signals the playback to repeat the message until individual 17 acknowledges the message by pressing switch 9*a*, which turns off playback 3*a*.

A series of three packets of medication labeled "B" is placed on the table. The recorded voice instruction on the tape in tape player 3*b* instructs individual 17 when the time arrives to take the medication in packet "B". Again the instruction is repeated until acknowledged and the playback 3*b* turned off. At a later time during the same day, timer 7 again turns on playback 3*c* instructing individual 17 to take the medication in packet "C" and the process is repeated later in the same day for the fourth set of packets of medication labeled "D". The timer 7 can be set to instruct the individual 17 to take any packet of medication at any time by having the particular recorded instruction played.

While the unit of the present invention is powered with house current, it is preferred that the timed repeating instruction apparatus and method of the present invention also have a backup battery power supply to operate the device in case of power failure. A remote timer and timer modules to control the timing of the tape players are also used.

Other options include having the recording play through the individual's entire living quarters, including a buzzer attached to the individual's pillow to alert the individual that a recording providing instructions is to be played.

The basis of this invention is that all human beings should be free to live his or her life as they wish, yet adhere to a prescribed schedule of daily medical, dietary and hygienic requirements. The instruction device of the present invention can provide that schedule.

This invention should be limited solely by the following claims.

We claim:

1. An apparatus for instructing an impaired individual to perform an act comprising:

a plurality of voice recorders capable of recording a series of different voice recordings of a person whose voice is recognized by the individual to provide a series of different recorded instructions to the impaired individual, a plurality of playbacks capable of playing seriatim one of the series of said recorded instructions in said series;

a repeating means connected to each said playback capable of repeating the playing of said recorded instructions until stopped, a timer connected with each said playback, the timer capable of activating said playback at multiple, preselected time intervals to provide for a series of multiple timed recorded instructions played seriatim during the day to the impaired individual, a switch for each said repeating means operated by the impaired individual to stop the repeating means after any one of a selected playback of a recorded instruction.

* * * * *